US005250927A

United States Patent [19]

Nevels

[11] Patent Number: 5,250,927

[45] Date of Patent: Oct. 5, 1993

[54] INSIDE MOUNTING DOOR STOP AND ALARM

[76] Inventor: Kervis P. Nevels, 7401 San Pedro N.E., Space 10, Albuquerque, N. Mex. 87109

[21] Appl. No.: 909,105

[22] Filed: Jul. 1, 1992

[51] Int. Cl.[5] ..... G08B 13/08

[52] U.S. Cl. ..... 340/545; 200/61.93; 292/338

[58] Field of Search ..... 340/545, 546; 292/338, 292/339; 200/61.93

[56] References Cited

U.S. PATENT DOCUMENTS

| | | | |
|---|---|---|---|
| 3,896,316 | 7/1975 | Serrano | 340/545 |
| 4,442,427 | 4/1984 | Morton | 340/546 |
| 4,607,253 | 8/1986 | Wooten et al. | 340/546 |
| 4,759,577 | 7/1988 | Thomas, III | 292/338 |
| 5,135,273 | 8/1992 | MacCalder | 292/338 |

*Primary Examiner*—Glen R. Swann
*Attorney, Agent, or Firm*—Richard A. Bachand

[57] ABSTRACT

A door-stop alarm has a frame adapted to be affixed to an inside surface of a door, and a rotatable lever carried on the frame rotatably movable between a position engaging a floor surface and a position away from engagement with the floor surface. Means for are provided for translating rotational movement caused by slight opening of the door to upward movement of one end of the rotatable lever. An alarm switch is provided within the frame, and a projection on the rotatable lever engages the alarm switch upon upward movement of the rotatable lever. The rotatable lever comprises a portion to engage the alarm switch for turning the alarm circuit on and off when the lever is rotated to a position away from the position engaging the floor surface.

20 Claims, 2 Drawing Sheets

INSIDE MOUNTING DOOR STOP AND ALARM

BACKGROUND OF THE INVENTION

1. Field of the Invention

This invention relates to improvements in door stop alarms, and, more particularly, to improvements in door stop alarms of the type which prevent intrusion and sound an alarm when intrusion is attempted.

2. Description of the Prior Art

In the past, numerous door stops to prevent intrusion have been advanced, many in conjunction with alarms to warn of an entry attempt. For example, U.S. Pat. No. 4,890,092 discloses a wedge shaped door stop that can be inserted beneath a door. The device prevents opening the door and sounds an alarm when an attempt is made to open the door.

U.S. Pat. No. 828,834 shows a portable door engaging stop with toothed and portions to engage the door and the floor, and which are slideably located with respect to each other to close a connection to sound a bell when the door is attempted to be opened.

U.S. Pat. No. 2,870,281 shows a burglar alarm that is connected between the door knob of the door and a nearby floor location, and which has a separate alarm circuit to warn of attempted entry. Similar devices are advanced in U.S. Pat. Nos. 4,607,253; 4,358,758; and 4,442,427.

A number of alarms are provided which have a door engaging lever that is compressed or allowed to spring out to sound an alarm upon opening of the door. Examples of this type of alarm are shown in U.S. Pat. Nos. 2,826,656; 4,193,067; and 4,266,216.

Finally, a portable alarm for entry detection is shown in U.S. Pat. No. 4,264,899 that sounds an alarm when it is tilted to a predetermined extent from its upright position.

SUMMARY OF THE INVENTION

In light of the above, therefore, it is an object of the invention to provide an improved door stop and alarm.

It is another object of the invention to provide an improved door stop and alarm of the type described that can be mounted on an inside of a door to both prevent opening of the door and to sound an alarm in the event an attempt is made to open the door.

It is another object of the invention to provide a door stop and alarm of the type described that provides a warning alarm that is triggered by an attempt to open the door and which can be sustained until manually turned off.

These and other objects, features, and advantages will become apparent to those skilled in the art from the following detailed description when read in conjunction with the accompanying drawings and appended claims.

In accordance with a broad aspect of the invention, a door-stop alarm is provided. The door-stop alarm has a frame adapted to be affixed to an inside surface of a door and a rotatable lever carried on the frame rotatably movable between a position engaging a floor surface and a position away from engagement with the floor surface. Means for are provided for translating rotational movement caused by slight opening of the door to upward movement of one end of the rotatable lever. An alarm switch is provided within the frame, and a projection on the rotatable lever engages the alarm switch upon upward movement of the rotatable lever. The rotatable lever comprises a portion to engage the alarm switch for turning the alarm circuit on and off when the lever is rotated to a position away from the position engaging the floor surface.

BRIEF DESCRIPTION OF THE DRAWINGS

The invention is illustrated in the accompanying drawings in which.

In the various figures of the drawing, like reference numerals are used to denote like or similar parts.

DETAILED DESCRIPTION OF THE PREFERRED EMBODIMENT

Figure 1:
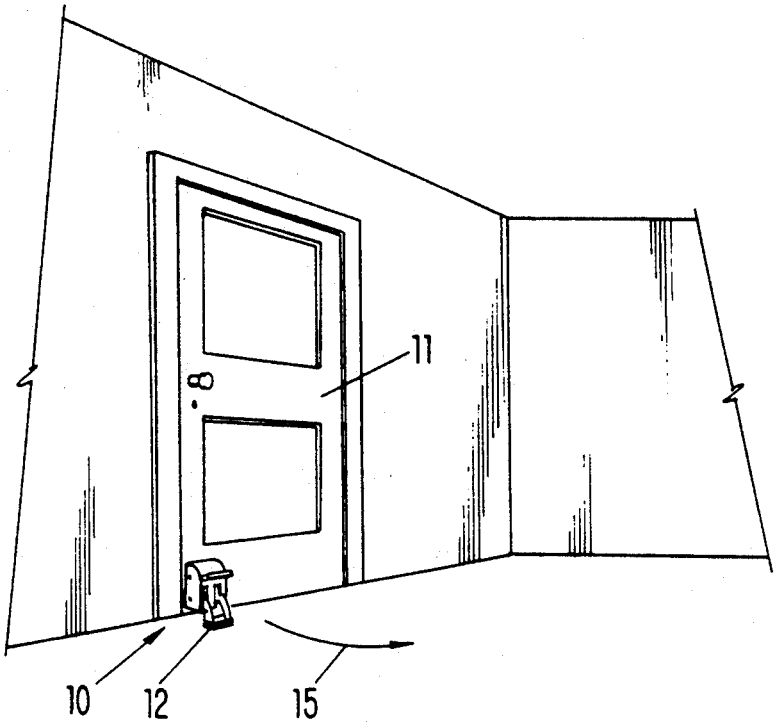
FIG. 1 is a perspective view of the door stop alarm installed on a door, in accordance with a preferred embodiment of the invention.
Figure 2:
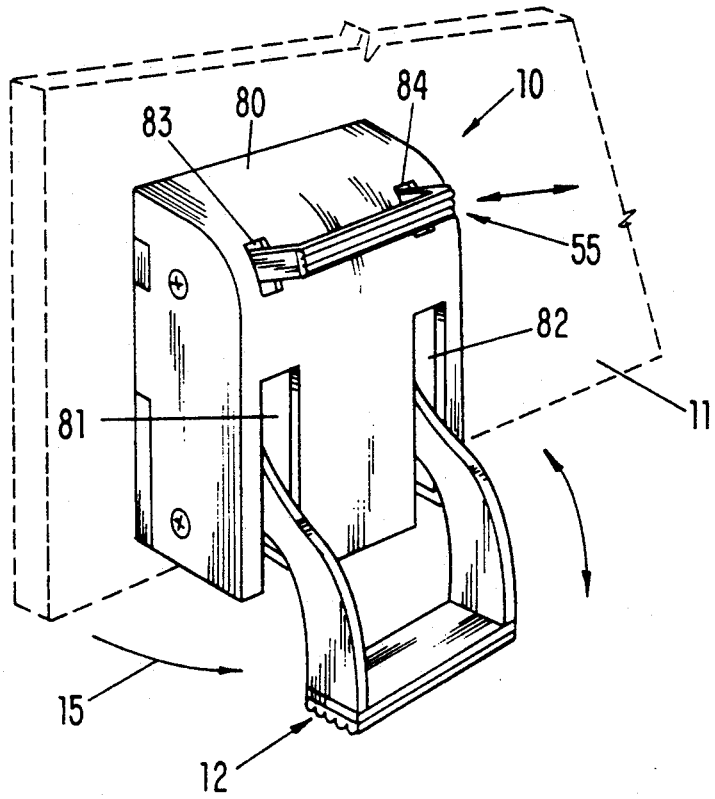
FIG. 2 is an enlarged isometric view of the door stop of FIG. 1.

A preferred embodiment of the invention is illustrated with reference now to FIGS. 1–4. The door stop alarm 10, in accordance with a preferred embodiment of the invention, is intended for mounting on an interior face of a door 11, as shown in FIG. 1. The door stop alarm 10 is intended to be mounted onto the door Il on the side which will allow the floor engaging lever 12 to prevent the door from being opened in the direction of the arrow 15. This is in contrast to door stops typically found in the prior art which are used to hold a door in an open position and prevent it from closing. Thus, the door stop alarm 10 operates, in one aspect, to prevent an intruder from entering a room through a door on which the door stop alarm 10 is installed.

Figure 3:
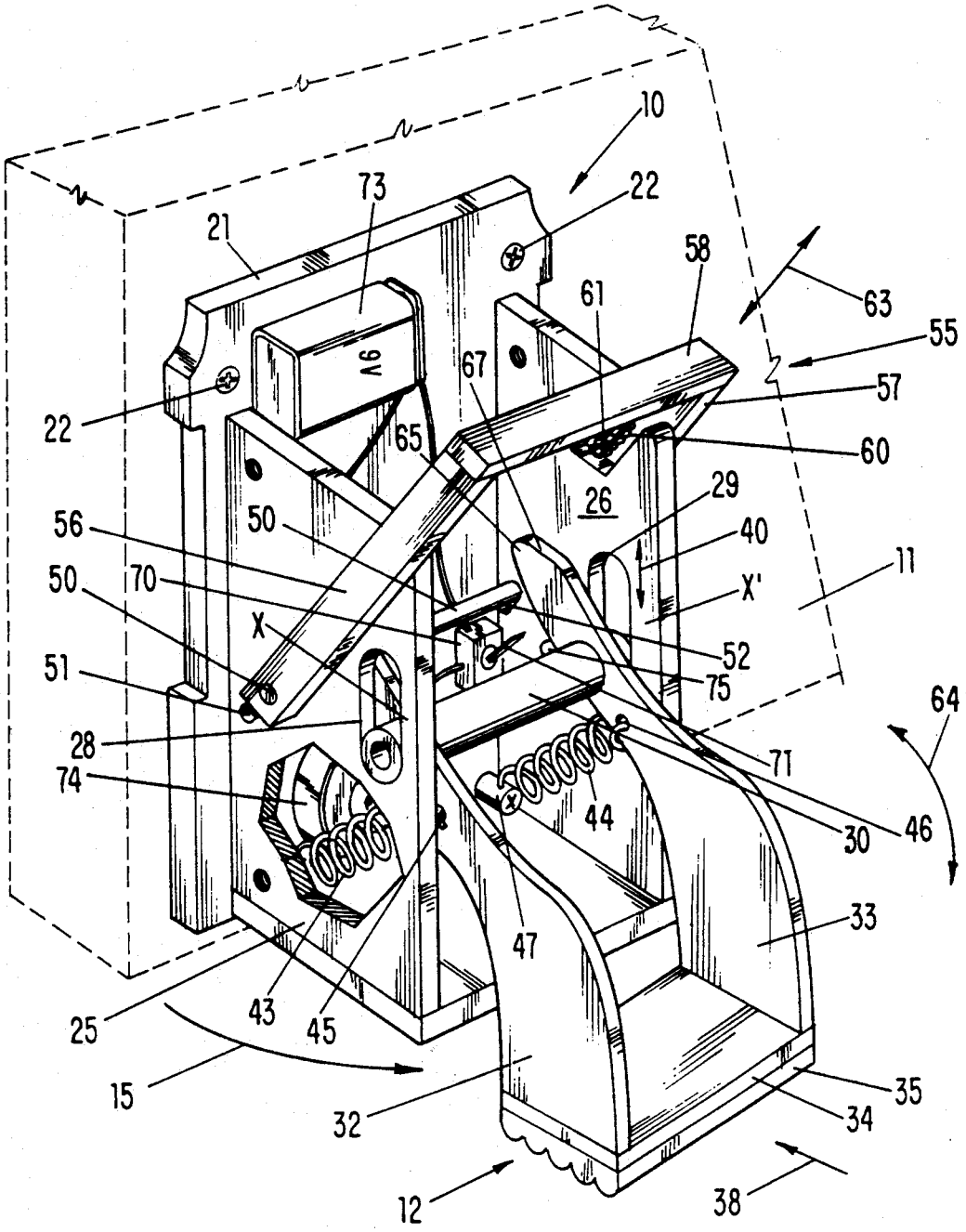
FIG. 3 is an isometric view of the door stop alarm, of the invention, on which the cover has been removed to illustrate the interior mechanisms thereof.
Figure 4:
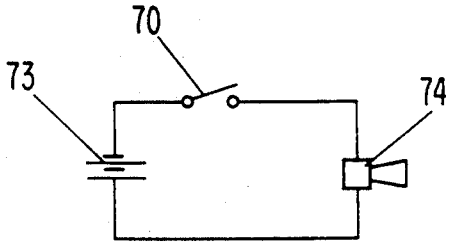
FIG. 4 is an electrical schematic diagram of the alarm circuit of the door stop alarm of the invention.

The details of the construction of the door stop alarm 10 are shown particularly in FIG. 3. The door stop alarm 10 has a base plate 21 that can be attached by screws 22 or other fastening means to the door 11. A frame having left and right side walls 25 and 26 is attached to the base plate 21.

A pair of vertically oriented slots 28 and 29 are provided respectively in the left side wall 25 and right side wall 26 to rotatably and slideably receive a pin 30 on which the floor engaging lever assembly 12 is carried.

The floor engaging lever assembly 12 includes left and right side lever arms 32 and 33 that are interconnected by a base plate 34. An elastomeric member 35, for example of rubber or other pliable material, is fastened to the bottom of the base plate 34 to engage the floor when the lever assembly 12 is in its lowered position, as illustrated.

The left and right side arms 32 and 33 are carried upon the pin 30, whereby when a force is directed in the direction of the floor engaging lever assembly 12, as denoted by the arrow 38, such as that which would be experienced if an attempt were made to open the door in the direction of the arrow 15, the pin 30 that carries the floor engaging lever assembly 12 would be moved upwardly within the slots 28 and 29, in the direction denoted by the arrow 40. When the pin 30 has reached the full extent of travel permitted within the slots 28 and 29, the door stop aspect of the door stop alarm 10 becomes fully implemented, and further motion of the door in the direction of the arrow 15 is prohibited.

Springs 43 and 44 are provided, each connected between a respective hole 45 and 46 in the respective left and right side arms 32 and 33 at one end and to posts mounted on the base plate 21 at the other end, the right side post 47 being shown, for example. The springs 43 and 44, therefore, serve to bias the floor engaging lever assembly 12 downwardly to engage the floor when the door stop alarm 10 is being operated in its capacity as a door stop or block.

On the other hand, when it is desired to disable the door stopping function of the door stop alarm 10, a rod or bar 50 is provided between diagonal slots 51 and 52 respectively formed in the left and right side walls 25 and 26. The bar 50 is attached to a foot lever assembly 55 having left and right uprights 56 and 57 interconnected by a bar member 58. The foot lever assembly 55 is biased upwardly to the top extent allowed by the slots 51 and 52 by springs, such as the spring 60 illustrated. Guide posts 61 may be provided, as shown, to assure linearity of sliding operation of the foot lever assembly 55 in the direction of the arrow 63.

Thus, in operation, upon rotation of the floor engaging lever assembly 12 in the direction of the arrow 64 upwardly, the tip portions of the left and right side arms 32 and 33, such as the tip 65 which is visible in the drawing of FIG. 3, engages the rod 50 that interconnects the left and right uprights 56 and 57, forcing the rod 50 downward within the slots 51 and 52. The springs attached to the foot lever assembly 55 force the rod 50 back to its original upright position after the tips 65 have cleared the rod 50 during the upward rotational travel of the floor engaging lever assembly 12. When the upward rotation of the floor engaging lever assembly 12 is discontinued and pressure on it is released, as gravity pulls on the end carrying the elastomeric member 35 and base plate 34, the upward edge of the side arms 32 and 33 engage the bottom of the rod 50, preventing the floor engaging lever assembly 12 to return to its downward position. The upward edge 67 of the right side arm can be seen in FIG. 3.

To release the floor engaging lever assembly 12 to once again return by rotational movement to the floor engaging position shown, downward pressure in the direction shown by the arrow 63 onto the bar member 58 can be exerted, for example, by stepping on the bar member 58. This downward motion moves the member 50 downwardly in slots 51 and 52 beyond the tip 65 of the floor engaging lever assembly 12 to release it.

To provide the alarm function of the door stop alarm 10, a switch 70 is provided that has a lever 71 extending in the direction of the back of the right side arm 33. The switch 70 is connected in a circuit with a battery 73 and alarm horn 74 so that when the switch 70 is closed by upward movement of the switch lever 71 (as shown) the circuit including the battery 73 and horn 74 is closed to sound the alarm. In order to move the switch lever 71 to the closed position, a protrusion or projection 75 is provided on the back side of the right side arm 33. The protrusion 75 and switch 70 are located within the frame provided by the walls 25 and 26 such that the protrusion 75 engages the switch lever 71 during upward travel of the pin 30 within the slots 28 and 29.

If desired, the protrusion 75 and switch lever 71 can be further located with respect to each other such that once the switch lever 71 has been actuated by its engagement with the protrusion 75, the protrusion 75 is no longer able to re-engage the switch lever 71, for example, by subsequent downward movement of the pin 30 to its downward position. Thus, once the alarm provided by the door stop alarm 10 of the invention has been actuated, it can not shut off by merely releasing the pressure on the door or allowing the floor engaging lever assembly 12 to be pulled back to the original floor engaging position.

In this embodiment, in order to turn the alarm off after it has been triggered, the entire floor engaging lever assembly 12 must be manually rotated in the upward direction shown by the arrow 64 past the point at which the tip of the side arm 33 would engage the rod 50, to a point at which the tip 65 of the side arm 33 engages the top surface of the switch lever 71 to flip it back to the of position.

The entire assembly as shown in FIG. 3 may be conveniently covered with a cover 80 (see FIG. 2) that is provided with slots 81 and 82 to receive the left and right side arms 32 and 33 and with slots 83 and 84 to receive the left and right uprights 56 and 57.

If desired, to increase the degree of engagement of the floor engaging lever assembly 12, depending upon whether the door 11 upon which it is mounted opens left-to-right or right-to-left, the respective slots 28 and 29 can be formed to receive the pin 30 at slightly different angles with respect to the plane of the door 11. Thus, for example, the floor engaging lever assembly 12 can be oriented with a slight angle (as shown by the dimension designations "x" and "x'" on the respective left and right sides of walls 25 and 26 in FIG. 4) to face more directly the path over which it travels as the door is opened.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A door-stop alarm, comprising:

a frame adapted to be affixed to an inside surface of a door;

a rotatable lever carried on said frame rotatably movable between a position engaging a floor surface and a position away from engagement with the floor surface;

means for translating rotational movement caused by slight opening of the door to upward movement of one end of the rotatable lever;

an alarm switch;

and a projection on said rotatable lever that engages said alarm switch upon upward movement of said rotatable lever.

2. The door-stop alarm of claim 1 wherein said rotatable lever comprises a portion to engage said alarm switch for turning the alarm circuit on and off when the lever is rotated to a position away from said position engaging said floor surface.

3. The door-stop alarm of claim 1 further comprising biasing means attached between said rotatable lever and said frame to bias said rotatable lever to said position engaging a floor surface.

4. The door-stop alarm of claim 3 wherein said biasing means are springs.

5. The door-stop alarm of claim 1 further comprising a rotatable lever holding assembly carried in said frame, said rotatable lever holding assembly located to engage said rotatable lever when said rotatable lever is rotated away from said position engaging a floor surface to hold releasably the rotatable lever in a non-engaging position.

6. The door-stop alarm of claim 5 wherein said rotatable lever holding assembly comprises:

a rod located to engage an end of said rotatable lever opposite said one end that engages the floor surface, and a handle selectively to move the rod to not engage the end of said rotatable lever, whereby said rotatable lever is moved by said biasing means to engage the floor surface.

7. The door-stop alarm of claim 6 wherein said handle is a foot actuatable handle.

8. The door-stop alarm of claim 1 wherein said rotatable lever comprises a pair of lever arms, a pivot pin interconnected between said pair of lever arms, and a floor engaging means carried between said pair of lever arms at the one end that engages the floor surface.

9. The door-stop alarm of claim 8 wherein said floor engaging means comprises an elastomeric member to engage the floor surface.

10. The door-stop alarm of claim 8 wherein said frame comprises a base plate and left and right walls, said left and right walls having vertical slots therein in which said pivot pin is located.

11. The door-stop alarm of claim 8 wherein said vertical slots are offset to offset the pair of rotatable lever arms.

12. A door-stop alarm, comprising:

a lever and a frame assembly, said frame assembly being affixable to an inside surface of a door at a location whereby the lever engages a surface of a floor when said frame assembly is affixed to said surface of the door;

a pivot pin carrying said lever, constrained within said frame assembly to allow rotational and up and down movement of said lever with respect to said frame assembly, whereby when said door is opened slightly when said lever is in a downward, floor-engaging position, said lever is constrained to move upwardly with respect to said frame;

biasing means attached between said lever and said frame assembly to bias said lever to said downward, floor-engaging position at which one end of said lever engages the surface of the floor;

a rod assembly carried in said frame assembly, said rod assembly including:

a rod located to engage an end of said lever opposite said one end that engages the surface of the floor, when said lever is rotated away from said downward, floor-engaging position, to hold the lever in a downward, floor-non-engaging position;

and a handle to move the rod assembly from said lever, said handle being actuatable to release said lever from being held in said downward, floor-non-engaging position to be moved by said biasing means to said downward, floor-engaging position;

an alarm circuit including a switch for turning the alarm circuit on and off;

and a projection on said lever that engages said switch when said lever is moved in an upward direction with respect to said frame assembly to turn on said alarm circuit.

13. The door-stop alarm of claim 12 wherein said biasing means is a spring.

14. The door-stop alarm of claim 12 wherein said frame assembly comprises a base plate and left and right walls, said left and right walls having vertical slots therein in which said pivot pin is located.

15. The door-stop alarm of claim 14 wherein said lever comprises a pair of lever arms and a floor engaging means carried between said pair of lever arms at the one end that engages the surface of the floor.

16. The door-stop alarm of claim 15 wherein said lever comprises a portion to engage the switch when the lever is rotated to a floor-non-engaging position to turn off said alarm circuit.

17. The door-stop alarm of claim 15 wherein said floor engaging means comprises an elastomeric member to engage the surface of the floor.

18. The door-stop alarm of claim 15 wherein the rod of said rod assembly is located in diagonally oriented slots in said left and right walls of said frame assembly and wherein said rod assembly further comprises means for biasing said rod in a direction toward said lever to engage said end of said lever when said lever is rotated away from said downward, floor-engaging position.

19. The door-stop alarm of claim 18 wherein said handle comprises left and right members and a top member interconnected between said left and right members, said left and right members carrying said rod, and wherein said means for biasing said rod comprises springs located between said left and right walls and said top member.

20. A door-stop alarm, comprising:

a pair of lever arms;

a floor engaging means carried between said pair of lever arms at one end thereof;

a frame assembly that is affixable to an inside surface of a door at a location to allow the pair of lever arms to be movable to bring the floor engaging means into engagement with a surface of a floor, said frame assembly comprising a base plate and left and right walls, said left and right walls having vertical slots;

a pivot pin carrying said lever arms, constrained within said vertical slots in said frame assembly to allow rotational and up and down movement of said lever with respect to said frame assembly, whereby when said door is opened slightly when said lever is in a downward, floor-engaging position, said lever arms are constrained to move upwardly with respect to said frame, but to prevent the door from opening;

a pair of springs each attached between one of said lever arms and said frame assembly to bias said lever arms to said downward, floor-engaging position at which said floor engaging means engages the surface of the floor;

a rod located within said frame assembly to engage another end of said lever arms opposite said one end that carries the floor engaging means, when said lever arms are rotated away from said downward, floor-engaging position, to hold the lever arms in a downward, floor-non-engaging position;

and a handle to move the rod assembly from said another end of said lever arms, said handle being actuatable to move said rod to release said lever arms from being held in said downward, floor-non-engaging position to be moved by said pair of springs to said downward, floor-engaging position;

an alarm, a switch, and a battery circuit connected in series, said switch being connected to turn the alarm on and off;

a projection on one of said lever arms that engages said switch when said lever arms are moved in an upward direction with respect to said frame assembly to turn on said alarm; and a portion of said one of said lever arms engaging the switch for turning the alarm off when the lever arms are rotated to a floor-non-engaging position.

* * * * *